United States Patent [19]

Planert et al.

[11] Patent Number: 4,771,729

[45] Date of Patent: Sep. 20, 1988

[54] SYSTEM FOR AUTOMATIC ELECTROSTATIC SPRAY COATING

[75] Inventors: Albert Planert, Heusenstamm; Winfried Ott, Rodgau; Gunther Fleig, Hanau, all of Fed. Rep. of Germany

[73] Assignee: Ransburg GmbH, Heusenstamm, Fed. Rep. of Germany

[21] Appl. No.: 794,072

[22] Filed: Nov. 1, 1985

[30] Foreign Application Priority Data

Nov. 5, 1984 [DE] Fed. Rep. of Germany ..... 3440381

[51] Int. Cl.[4] ..... B05B 5/02; B05C 11/10

[52] U.S. Cl. ..... 118/697; 118/629; 118/706; 239/305

[58] Field of Search ..... 118/310, 629, 630, 302, 118/697, 706; 239/305; 222/136; 137/268

[56] References Cited

U.S. PATENT DOCUMENTS 4,017,029 4/1977 Walberg ..... 118/629 X
4,313,475 2/1982 Wiggins ..... 141/18

FOREIGN PATENT DOCUMENTS 1393333 5/1975 United Kingdom .

*Primary Examiner*—Evan K. Lawrence
*Attorney, Agent, or Firm*—Barnes & Thornburg

[57] ABSTRACT

A method and system are provided for dispensing only that amount of coating material which is required for coating a series of one or more articles to be coated by the coating material. The method and system include the step of, and apparatus for, feeding that amount of coating material to an intermediate container. The intermediate container receives the coating material from a color changer. The connection between color changer and intermediate container is so designed that no electrical current flow exists between these two components, even when using electrically conducting coating material. The coating material is electrostatically charged at an atomizer downstream from the intermediate container during a spray operation. When a coating material change is required, the amount of coating material dispensed into the intermediate container has essentially been exhausted, making it possible to clean the system components affected by the coating material change with very little waste and within a short time, so that the new coating material will not be contaminated by residue of the previously used coating material.

15 Claims, 2 Drawing Sheets

SYSTEM FOR AUTOMATIC ELECTROSTATIC SPRAY COATING

The invention concerns a system for automatic electrostatic spray coating of articles.

In electrostatic spray coating of articles with electrically conductive coating materials, for instance water-based paints, the problem is encountered that the voltage carried by electrodes or other parts of the atomizer that serve the electrostatic charging of the coating material is conducted through the electrically conductive coating material to grounded parts that are arranged upstream from the atomizer and feed the coating material to it. The coating material containers of prior devices are grounded and very large because they supply a number of atomizers with coating material, so that a substantial hazard would exist if the containers were connected to the same high voltage as the atomizer parts which charge the coating material. On the other hand, high voltage arc-overs between parts of the system must be avoided. Therefore, if possible, all charged parts should carry an equal electrical potential. Another problem is that, when changing from one coating material type to another, for example, from one color to another, the affected system parts must be thoroughly cleaned within a short time from residues of the previously used coating material, so that these residues will not adulterate the newly used coating material. Prior methods and devices making it possible to spray electrically conductive coating materials typically are very large in volume, and a change from one coating material to another, if it is to be performed within a sufficiently short time, requires a very large equipment expense. In large coating application systems using several atomizers, for instances, such as for painting automobile bodies, the prior devices are suited only for coating operations using a single color due to the problems mentioned above. The application of finish coatings from electrically conductive coating materials, depending on the system, may require keeping 5 to 25 different colors on change.

The German patent disclosure 29 00 660 teaches a device for the automatic electrostatic spray coating of articles with electrically conductive coating material where a filling container shuttles back and forth between a coating material supply system and an intermediate container, receiving coating material from the supply system in one position and being separated from it in the other position and transferring the coating into the intermediate container.

Moreover, the German patent document No. 29 37 890 teaches a device where the coating material is transferred droplet-wise into an intermediate container supplying an atomizer with coating material, where the spacing between individual coating material droplets prevents an electrical arc-over from the container walls to the coating material feed line. The voltage required for charging the coating material by the atomizer is very high and may amount to up to 140,000 volts Therefore, the diameter of the intermediate container of this prior device must be at least 500 mm. From page 26 of German patent disclosure No. 29 00 660, it follows that the intermediate container capacity is 100 liters. Intermediate containers of the prior devices are very large.

A conductance of the high voltage of the coating material to system components located upstream from the atomizer can be avoided if, according to other prior devices, the electrostatic charging of the coating material is not performed by parts of the atomizer but by electrodes which are arranged upstream from the atomizer and separate from it. But this has the great disadvantage that with this prior type, the transfer efficiency of the coating material processing ranges considerably below that of the former methods employing direct electrical charging of the coating material in or on the atomizer.

The problem to be solved by the invention is providing a system making it possible to use electrically conductive coating materials alternately and at substantial economy, in a number of colors. With the apparatus of the invention, it is possible to charge the electrically conductive coating material electrostatically through elements of the atomizer and, when changing over from one coating material to another, thoroughly clean residues from the system at reduced equipment and time expense. This should be possible irrespective of whether the atomizer is a pneumatic atomizer (atomizing the coating material through compressed air) or an airless atomizer or an atomizer bell or any other atomizer type.

The invention makes it possible to spray electrically conductive coating materials which are electrostatically charged with high voltage by elements of the atomizer economically. Moreover, a thorough cleaning from the device of residues of a coating material previously used is possible at low equipment expense and within a short time, in the order of 10 to 20 seconds, before another electrically conductive coating material is sprayed.

The invention may best be understood by referring to the following description and drawings which illustrate the invention. In the drawings.

Figure 1:
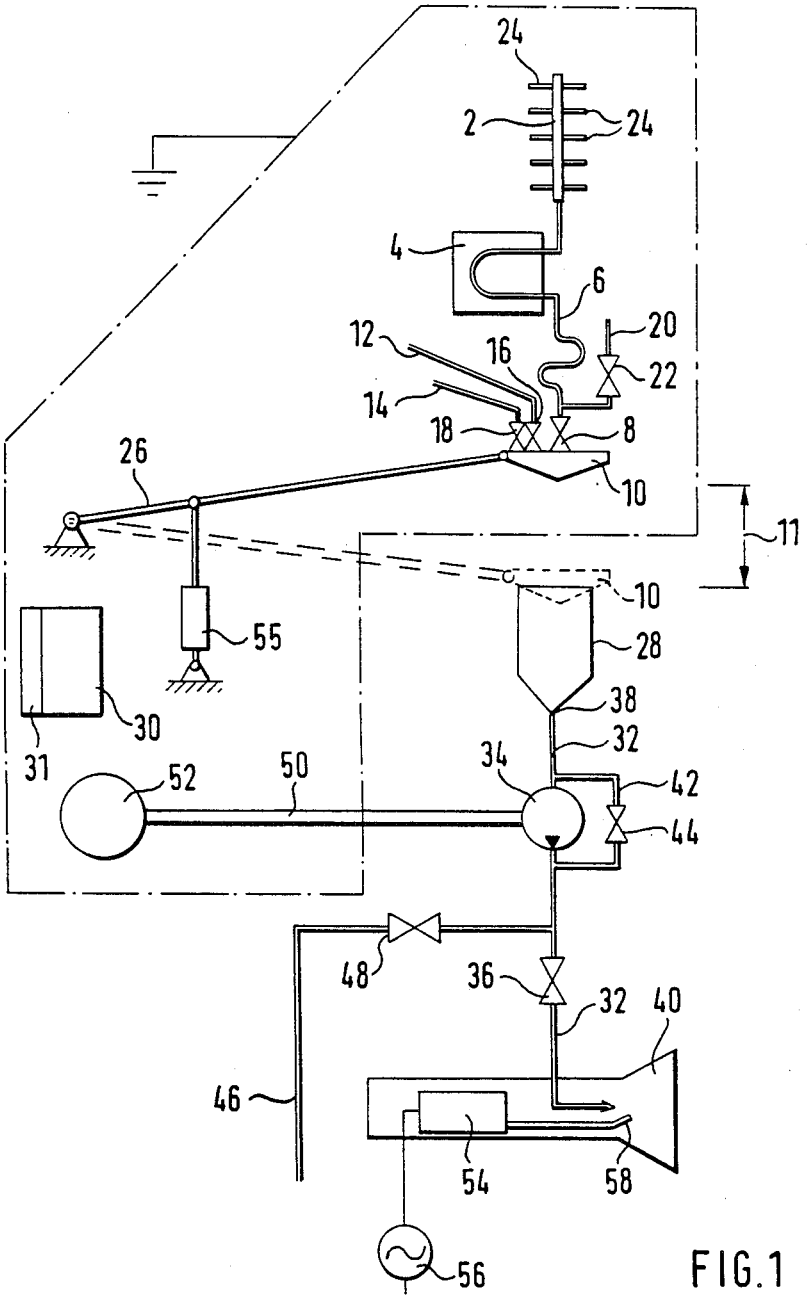
FIG. 1 illustrates schematically a system according to the invention.

The system presented in FIG. 1, for automatic electrostatic coating of articles with various electrically conductive coating materials, comprises a coating material changer 2, and a portioning device comprising a volumetric flowmeter 4 which is coupled through a dispensing line 6 with a shut-off valve 8 to a filler head 10 and extends through it. A solvent line 12 and a cleaning air line 14 pass through respective shut-off valves 16 and 18 and into the filler head 10. Immediately upstream from the shut-off valve 8, a line 20 with a shut-off valve 22 branches off the dispensing line 6 for passing rinsing fluid. The coating material changer 2 is provided with a number of couplers 24 which couple it to different coating material supplies.

The filler head 10 is supported by a device 26, making it possible to move the filler head from a cut-off position indicated by solid lines into a filling position indicated by broken lines, in which filler head 10 closes an intermediate container 28 pressure-tight. The filler head 10 is adjusted by a control 30 which is coupled to a computer 31. In the cut-off position, the filler head 10 is spaced a distance from the intermediate container 28 which is sufficiently large to avoid an electrical arc-over from the intermediate container 28 to the filler head, even if the intermediate container 28 is coupled to high voltage and the filler head 10 is coupled to ground potential. Thus, the distance of the filler head 10, in its cut-off position, from the intermediate container 28 forms an electrically nonconductive coating material path 11.

A coupling line 32 comprises a feed device 34 and a shut-off valve 36 and couples the lowest point 38 of the intermediate container 28 with an atomizer 40. The atomizer 40 may be a pneumatic atomizer, airless atomizer, a spray bell or any other known type atomizer. The feed device is a gear pump 34. It is paralleled by a bypass 42 comprising a shut-off valve 44. Immediately upstream from the shut-off valve 36, a line 46 with a shut-off valve 48 branches off the coupling line 32. The gear pump 34 is driven through a shaft 50 of electrically insulative material by a motor, preferably a stepping motor 52. The atomizer 40 is coupled to a high voltage generator 54 which is coupled to a low voltage supply 56 and delivers high voltage to an electrode 58 for electrostatic charging of the coating material to be sprayed. The electrode 58 may be formed at the mouth or by some other part of the atomizer 40. With the high voltage generator circuit 54 turned on, electrostatic charging occurs in the coupling line 32 as far upstream as the intermediate container 28, through the electrode 58 and the conductive coating material. Therefore, all of the components affected thereby are also coupled to the voltage generated by the high voltage generator circuit through electrical lines (not shown), so as to prevent voltage differentials. All other parts of the system are coupled to ground potential, as illustrated by a dash-dotted line in the drawing. Therefore, the filler head 10 may be moved from the cut-off position illustrated by solid lines into the filling position indicated by broken lines only after a coating material dispensing operation has been completed and the high voltage generating circuit 54 has been shut off. The control and regulation of the illustrated components is handled through a control 30 governed by a program stored in the computer 31.

Only a single atomizer is coupled to the intermediate container 28 through the coupler line 32 comprising the gear pump 34. Only that amount of coating material required to coat a series of articles to be coated by the same coating material is fed to the intermediate container. That amount of coating material typically amounts to only a few hundred ccm. A series of one or more articles to be coated by the same coating material may be, for instance, an automobile body, or a specific number of articles, for instance fenders of an automobile. That amount of coating material required to coat a series of one or more articles is substantially exactly the amount of coating material required for coating the single series of one or more articles. Information related to a number of amounts of coating materials required for various series of one or more articles is stored in the computer 31. The system comprises facilities for recognizing characteristic features of the series of one or more articles and, governed thereby, calls up a specific amount of coating material from the computer 31. Also, a desired amount of coating material may also be adjusted manually on the computer 31. For example, if there are ten different colors and twenty different series of articles, two hundred values must be stored in the computer memory. It is important that the amount of coating material recalled from the memory corresponds substantially exactly to the amount required for one series of one or more articles during a coating operation, that is, not significantly more and not significantly less.

The following is a description of the process conducted by the system.

During a coating material dispensing operation, the high voltage generator circuit 54 is turned on and the atomizer 40, gear pump 34 and the intermediate container 28 carry the same voltage. The gear pump 34 is driven by the stepping motor 52.

During a coating material color change—changing from a coating material of one color to a coating material of another color—the high voltage generator circuit 54 is shut off and the filler head 10 is placed by a positioning device, illustratively a pneumatic cylinder 55, in pressure-tight orientation on the intermediate container 28, by moving the filler head 10 from the cut-off position shown in FIG. 1 in solid lines to the filling position indicated in FIG. 1 in broken lines. Rinsing solvent and flushing air are driven into the intermediate container 28 through the lines 12 and 14 and their valves 16 and 18, respectively, thereby cleaning the inside walls of container 28. The filler head 10 must seal the intermediate container 28 so firmly that specific pressures of the solvent and air can be built up in the intermediate container 28 and, while doing so and with the bypass valve 44 opened and the gear pump 34 running, the rinsing agent can be fed through the pump and through the bypass valve 44 to the atomizer 40 and/or the branch line 46. In the process, the valves 36 and 48 may be opened and closed simultaneously or alternately. When the rinsing is completed, the valves 16, 18 and 48 are closed and the shut-off valve 8 is opened permitting a predetermined amount of a specific coating material to flow into the intermediate container 28 through the flowmeter 4 and the filler head 10. The control 30 closes the shut-off valve 8 as soon as the flowmeter 4 has transmitted to the control 30 a signal corresponding to the desired amount of material.

Once the desired amount of coating material has been supplied to the intermediate container 28, the filler head 10 is lifted off the intermediate container 28 and moved into the cut-off position indicated by solid lines. The next coating material dispensing operation can now begin. During this next dispensing operation, the color changer is flushed with air and/or fluid and prepared for the next coating material color. The flowmeter 4 is simultaneously rinsed and cleaned through the valve 22.

Figure 2:
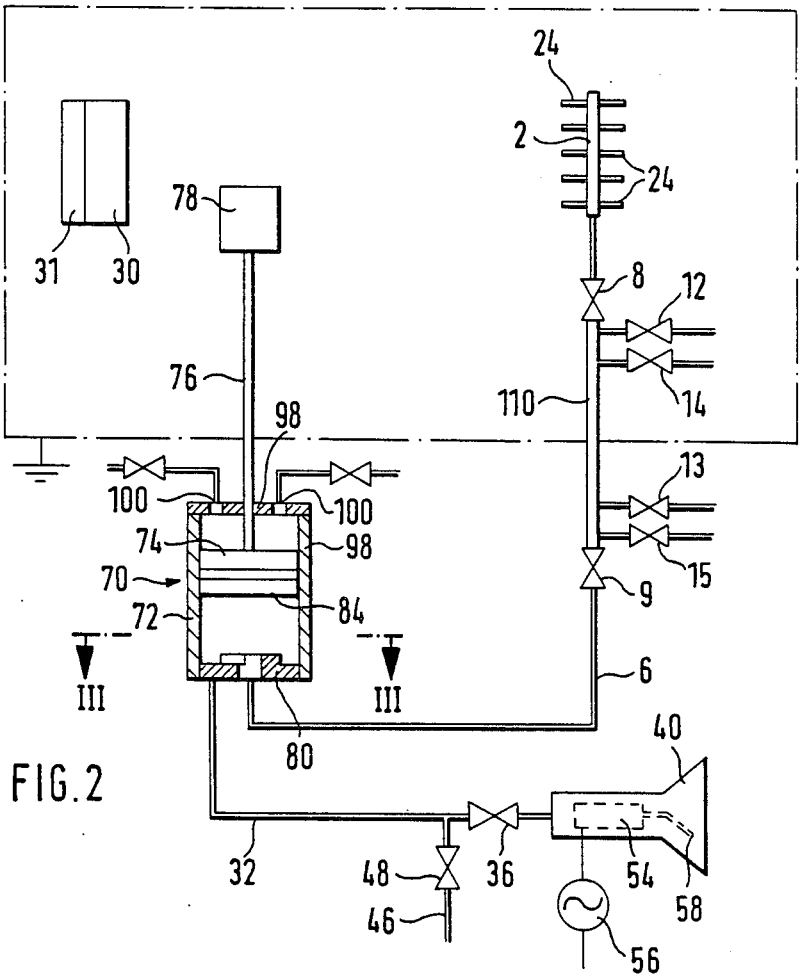
FIG. 2 illustrates schematically another emobodiment of the invention.

The system according to FIG. 2 for automatic electrostatic coating with various electrically conductive coating materials comprises, beginning at the most upstream end, the following elements: a coating material changer 2 with a number of connections 24 for connecting to various coating material supplies, a shut-off valve 8, a fluid line 110 constructed from electrically non-conducting material, another shut-off valve 9, a dispensing line 6, a flow control device 70, a connecting line 32 with a shut-off valve 36 running to an atomizer 40. Upstream from the shut-off valve 36, a branch line 46 with a shut-off valve 48 branches off from connecting line 32. The atomizer 40 is coupled to a high voltage generator 54 which is coupled to a low voltage supply 56. High voltage generator 54 delivers high voltage to an electrode 58 for electrostatically charging the coating material to be sprayed. The entire system is controlled by a control 30 governed by a computer 31. The components included inside a dash-dotted line are grounded. All other components are connected to the same high voltage as the electrode 58.

In FIG. 2, elements referenced the same as in FIG. 1 correspond functionally to elements in FIG. 1:

The fluid line 110 has a length such that an electrical arc-over from its one end to its other end is safely avoided when no electrically conductive coating material is contained in it, but the shut-off valve 8, the solvent valve 12 and the air valve 14 are connected to ground potential at their front ends, while the shut-off valve 9 and additional solvent and air valves 13 and 15, respectively, are connected with their other end to high voltage. Valves 13 and 15 serve to supply solvent and air, respectively, through the fluid line 110, so as to cleanse that line of coating material and dry it during the time when the high voltage generator circuit 54 is activated.

The flowmeter 70 comprises an intermediate container 72 having the form of a cylinder in which a piston 74 is contained. The piston 74 is connected through a rod 76 of electrically insulating material to a position signal generator 78. The position signal generator 78 is preferably a linear drive or an electromotor with a gearbox. This Position signal generator 78 can retract the piston 74 at a desired speed into a desired position, thereby sucking a specific amount of coating material, namely that amount required to coat a series of one or more articles from the coating material changer 2 through the opened valves 8 and 9 and the dispensing line 6 into the intermediate container 72. First the shut-off valve 8 and then the shut-off valve 9 are successively closed during the last part of the suction stroke of the piston 74 so that the fluid line 110 will no longer contain any coating material at the end of the suction stroke of the piston 74. Following the suction stroke, the piston 74 moves in the opposite direction at an adjustable speed so as to feed the stored coating material in an amount sufficient to coat a series of one or more articles to the atomizer 40. The high voltage generator circuit 54 is activated during this stroke so that the sprayed coating material will be electrostatically charged.

Figure 3:
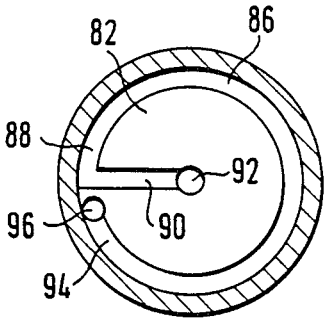
FIG. 3 illustrates a section through an intermediate container of the system illustrated in FIG. 2 along the section lines III—III.

With reference to FIG. 3, the bottom 80 of the intermediate container 72 has a smooth surface 82 on which the smooth end face 84 of the piston 74 bears at the end of the feed stroke, forcing all of the coating material radially outward into a circular groove 86 at the outer circumference of the bottom 80. The start 88 of the circular groove 86 is coupled through a radial groove section 90 with an inlet 92 to which the dispensing line 6 is coupled. The end 94 of the ciircular groove 86 is spaced close to the beginning 88 and empties into an outlet 96 to which line 32 is coupled. Repeated "tapping" of the piston 4 on the bottom 80 by the position signal generator 78 causes much of the coating material residue to drop off the piston 74 and the cylindical container wall 98 at the end of the feed stroke and, because the smooth and flat surfaces 82 and 84 are in intimate contact, to be forced into the circular groove 86. The lid 98 of the intermediate container 72 includes a compressed air connection 100 and a vacuum connection 102.

What is claimed:

1. A system for automatic electrostatic spray coating of articles, characterized by an atomizer, a portioning device for delivering an amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, and means for coupling the intermediate container to the atomizing device, the portioning device comprising a flow measuring instrument.

2. A system according to claim 1, characterized in that the means for coupling the portioning device to the intermediate container comprises a fluid line constructed from electrically non-conductive material.

3. A system for automatic electrostatic spray coating of articles, characterized by an atomizer, a portioning device for delivering substantially only that amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, and means for coupling the intermediate container to the atomizing device, the means for coupling the portioning device to the intermediate container comprising a portion which can be rendered electrically non-conductive, the means for coupling the portioning device to the intermediate container comprising a filler head, the portioning device comprising means for moving the filler head between a filling position and a shut-off position, the filler head sealing the intermediate container pressure-tight in the filling position so as to feed the amount of coating material necessary to coat a series of one or more articles through the filler head into the intermediate container, the filler head in the shut-off position being sufficiently distant from the intermediate container to reduce substantially the possibility of electrical arc-over between the filler head and intermediate container when the intermediate container is coupled to high voltage and the filler head is coupled to ground potential.

4. The system according to claim 3 wherein the portioning device comprises a flow measuring instrument.

5. A system for automatic electrostatic spray coating of articles, characterized by an atomizer, a portioning device for delivering substantially only that amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, and means for coupling the intermediate container to the atomizing device, a coating material changer for feeding one of a number of differently colored coating materials, and means for coupling the coating material changer to the portioning device, the means for coupling the portioning device to the intermediate container comprising a portion which can be rendered electrically non-conductive, the means for coupling the portioning device to the intermediate container comprising a filler head, the portioning device comprising means for moving the filler head between a filling position and a shut-off position, the filler head sealing the intermediate container pressure-tight in the filling position so as to feed the amount of coating material necessary to coat a series of one or more articles through the filler head into the intermediate container, the filler head in the shut-off position being sufficiently distant from the intermediate container to act as said non-conductive portion to reduce substantially the possibility of electrical arc-over between the filler head and intermediate container when the intermediate container is coupled to high voltage and the filler head is coupled to ground potential.

6. The system according to claim 5 wherein the portioning device comprises a flow measuring instrument.

7. A system for automatic electrostatic spray coating of articles, characterized by an atomizer, a portioning device for delivering an amount of coating material which is required for coating a series of one or more articles to be coating by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, means for coupling the intermediate container to the atomizing device, a coating material changer for feeding one of a number of differently colored coating materials, and means for coupling the coating material changer to the portioning device, the portioning device comprising a flow measuring instrument.

8. A system according to claim 7, characterized in that the means for coupling the portioning device to the intermediate container comprises a fluid line constructed from electrically non-conductive material.

9. A system for automatic electrostatic spray coating of articles, characterized by an atomizer, a portioning device for delivering an amount of coating material which is required for coating a series of one or more articles to be coating by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, means for coupling the intermediate container to the atomizing device, the means for coupling the portioning device to the intermediate container comprising an electrically non-conductive portion, the portioning device comprising a flow measuring device.

10. A system according to claim 9, characterized in that the electrically non-conductive portion comprises a fluid line constructed from electrically non-conductive material.

11. A system for automatic electrostatic spray coating of articles, characterized by an atomizer, a portioning device for delivering an amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, means for coupling the intermediate container to the atomizing device, a coating material changer for feeding one of a number of differently colored coating materials, and means for coupling the coating material changer to the intermediate container, the means for coupling the coating material changer to the intermediate container comprising an electrically non-conductive portion, the portioning device comprising a flow measuring instrument.

12. A system according to claim 11, characterized in that the electrically non-conductive portion comprises a fluid line constructed from electrically non-conductive material.

13. A system for automatic electrostatic spray coating of articles, characterized by an atomizer, a portioning device for delivering an amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, and means for coupling the intermediate container to the atomizing device, the means for coupling the portioning device to the intermediate container comprising a portion which can be rendered electrically non-conductive, the portioning device comprising a flow measuring instrument.

14. A system for automatic elecrostatic spray coating of articles, characterized by an atomizer, a portioning device for delivering an amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the intermediate container, means for coupling the intermediate container to the atomizer device, a coating material changer for feeding one of a number of differently colored coating materials, and means for coupling the coating material changer to the portioning device, the means for coupling the coating material changer to the portioning device comprising a portion which can be rendered electrically non-conductive, the portioning device comprising a flow measuring instrument.

15. A system for automatic electrostatic spray coating of articles, characterized by an atomizer, a portioning device for delivering substantially only that amount of coating material which is required for coating a series of one or more articles to be coated by the same coating material during the coating operation, an intermediate container for receiving the amount of coating material and for subsequently dispensing the amount of coating material as needed to the atomizer to be dispensed onto the one or more articles in the series, means for coupling the portioning device to the interemediate container, means for coupling the intermediate container to the atomizing device, a coating material changer for feeding one of a number of differently colored coating materials, and means for coupling the coating material changer to the portioning device, the means for coupling the portioning device to the intermediate container comprising a fluid line from electrically non-conductive material.

* * * * *